United States Patent [19]

Borel et al.

[11] Patent Number: 4,940,916

[45] Date of Patent: Jul. 10, 1990

[54] ELECTRON SOURCE WITH MICROPOINT EMISSIVE CATHODES AND DISPLAY MEANS BY CATHODOLUMINESCENCE EXCITED BY FIELD EMISSION USING SAID SOURCE

[75] Inventors: Michel Borel, Le Touvet; Jean-Francois Boronat, Grenoble; Robert Meyer, St Nazaire les Eymes; Philippe Rambaud, Claix, all of France

[73] Assignee: Commissariat a l'Energie Atomique, France

[21] Appl. No.: 266,681

[22] Filed: Nov. 3, 1988

[30] Foreign Application Priority Data

Nov. 6, 1987 [FR] France ..... 8715432

[51] Int. Cl.[5] ..... H01J 1/30; H01J 1/90; H01J 29/04

[52] U.S. Cl. ..... 313/306; 313/309; 313/336; 313/351; 313/444

[58] Field of Search ..... 313/306, 309, 336, 351, 313/444, 574, 575, 307, 308

[56] References Cited

U.S. PATENT DOCUMENTS

| | | | |
|---|---|---|---|
| 3,453,478 | 7/1969 | Shoulders | 313/309 |
| 3,671,798 | 6/1972 | Lees | 313/336 |
| 3,735,186 | 5/1973 | Klopfer | 313/346 |
| 3,789,471 | 2/1974 | Spindt | 29/25.17 |
| 3,935,500 | 1/1976 | Oess | 313/495 |
| 4,513,308 | 4/1985 | Greene | 357/55 |
| 4,663,559 | 5/1987 | Christensen | 313/336 |
| 4,721,885 | 1/1988 | Brodie | 313/336 X |

FOREIGN PATENT DOCUMENTS 0234989 9/1987 European Pat. Off. .

OTHER PUBLICATIONS

Patent Abstracts of Japan, vol. 7, No. 36; Feb. 15, 1983; Japanese Pat. Publication A 57187849 (Nippon Denshin Denwa Kosha) of Nov. 18, 1982.

*Primary Examiner*—Kenneth Wieder

[57] ABSTRACT

Electron source with micropoint emissive cathodes and display means by cathodoluminescence excited by field emission and using said source. Each cathode (5) comprises an electrically conductive layer (22) and micropoints (12) and, according to the invention, a continuous resistive layer (24) is provided between the conductive layer and the micropoints. The display means comprises a cathodoluminescent anode (16) facing the source.

8 Claims, 2 Drawing Sheets

ELECTRON SOURCE WITH MICROPOINT EMISSIVE CATHODES AND DISPLAY MEANS BY CATHODOLUMINESCENCE EXCITED BY FIELD EMISSION USING SAID SOURCE

The present invention relates to an electron source with micropoint emissive cathodes and to a display means by cathodoluminescence excited by field emission using said source.

The invention more particularly applies to the realization of simple displays, permitting the display of fixed images or pictures, and the realization of multiplexed complex screens making it possible to display animated pictures, e.g. of the television picture type.

French Patent application No. 8601024 of Jan. 24 1986 (French Patent No. 2593953) discloses a display by cathodoluminescence excited by field emission, comprising an electron source with micropoint emissive cathodes. It also describes a process for the production of said display.

Figure 1:
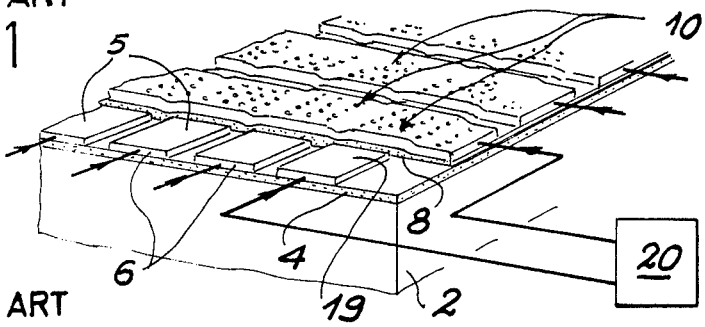
PRIOR ART FIG. 1

The electron source used in this known display is diagrammatically shown in FIG. 1. As can be seen, said source has a matrix structure and optionally comprises, on an e.g. glass substrate 2, a thin silica film 4, on which are formed a plurality of electrodes 5 in the form of parallel conductive layers or strips 6, which serve as cathode conductors and constitute the columns of the matrix structure. These cathode conductors 5 are covered with an electrically insulating film 8, e.g. of silica, except on the connecting ends 19 of said conductors, said ends being intended for the polarization of the conductors. Above the film 8 are formed a plurality of electrodes 10, once again in the form of parallel conductive strips. These electrodes 10 are perpendicular to the electrodes 5, which serve as grids and constitute the rows of the matrix structure.

Figure 2:
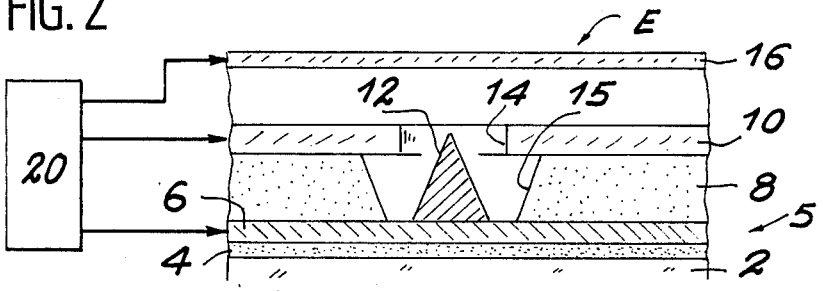
PRIOR ART FIG. 2

The known source also has a plurality of elementary electron emitters (micropoints), whereof one 12 is diagrammatically shown in FIG. 2. In each of the intersection zones of the cathode conductors 5 and the grids 10, the layer 6 of cathode conductor 5 corresponding to said zone is provided with a plurality of micropoints 12, e.g. of molybdenum and the grid 10 corresponding to said zone has an opening 14 facing each of the micropoints 12. Each of the latter is substantially in the form of a cone, whose pedestal rests on the layer 6 and whose apex or tip is level with the corresponding opening 14. Obviously, the insulating film 8 is also provided with openings 15 for the passage of micropoints 12.

FIG. 1 also shows that in preferred manner the grids as well as the insulating film 8 are provided with openings other than in the intersection zones, a micropoint being associated with each of the openings, which facilitates production in the case of the process described in the aforementioned application.

In a purely indicative and in no way limitative manner, each layer 6 has a thickness of approximately 0.2 micrometer, the electrically insulating film 8 a thickness of approximately 1 micrometer, each grid has a thickness of approximately 0.4 micrometer, each opening 14 a diameter of approximately 1.3 micrometer and the pedestal of each micropoint a diameter of approximately 1.1 micrometer.

The known means also comprises a screen E having a cathodoluminescent anode 16 positioned facing the grids and parallel to the latter. When the known means is placed under vacuum, by raising using control means

20 a grid to a potential of e.g. approximately 100 V with respect to a cathode conductor, the micropoints located in the intersection zone of said gate and said cathode conductor emit electrons. Anode 16 is advantageously raised by said means 20 to a potential equal to or higher than that of the grids. In particular, it can be earthed when the grids are earthed, or negatively polarized with respect to earth or ground.

The anode is then struck by electrons and consequently emits light. Thus, each intersection zone, which e.g. has $10^4$ to $10^5$ elementary emitters per $mm^2$, corresponds to a light spot on the screen.

The known electron source gives rise to a problem. It has been found that during the operation of said known means and particularly during its starting up and its stabilization period, local degasification occurs, which can produce electric arcs between different components of the means (points, grids, anodes). It is not possible in this case to limit the electrical current in the cathode conductors. A thrashing phenomenon occurs during which the current rises and, at a certain time, its intensity exceeds the maximum intensity Io of the current which can be withstood by the cathode conductors. Certain of them are then destroyed and no longer function, either partly or totally, as a function of the location of the destruction (breakdown). Therefore the known electron source is fragile and has a limited life.

To limit the intensity of the electrical current in the cathode conductors, it is possible to connect in series with each cathode conductor an electrical resistor having a sufficiently high value to conduct a current of intensity below the intensity of the breakdown current of said cathode conductor.

However, for response time reasons, these resistors can only be used with electron sources (particularly intended for the production of displays) of reduced size, complexity and operational possibilities.

Moreover, the known electron source causes another problem, which cannot be solved by using said aforementioned resistors. Thus, it has been found that if a micropoint of the known source has a particularly favourable structure, it emits a much higher electronic current than the other micropoints, so that on the screen E is produced an abnormally bright spot, which can constitute an unacceptable visual defect.

Therefore the known electron source has another disadvantage, namely that the display means using it can have significant punctiform brightness heterogeneities.

The present invention makes it possible not only to obviate the problem of fragility referred to hereinbefore, but also said other disadvantage, which was not the case with the source using resistors.

The invention therefore relates to an electron source comprising first parallel electrodes serving as cathode conductors, each cathode conductor having an electrically conductive layer, whereof one face carries a plurality of micropoints made from an electron emitting material and second parallel electrodes serving as grids and which are electrically insulated from the cathode conductors and form an angle therewith, which defines intersection zones of the cathode conductors and grids, the micropoints being located at least in said intersection zones, the grids also being positioned facing said faces and have holes respectively facing the micropoints, the apex of each micropoint being substantially level with the hole corresponding thereto, the micropoints of each intersection zone being able to emit electrons when the corresponding grid is positively polarized with respect to the corresponding cathode conductor, an electrical current then flowing in each micropoint of the zone, characterized in that each cathode conductor also has means for limiting the intensity of the electrical current flowing in each micropoint of said cathode conductor, said means having a continuous resistive layer located on the conductive layer of the corresponding cathode conductor, between said conductive layer and the corresponding micropoints, the latter resting on the resistive layer.

The term resistive layer is understood to mean an electrically resistant layer.

The invention makes it possible to limit the intensity of the current in each of the micropoints of each cathode conductor and conequently, a fortiori, makes it possible to limit the intensity of the electrical current flowing in the corresponding cathode conductor.

The use of these limiting means consequently makes it possible to increase the life of the source by minimizing the risks of destruction by breakdown caused by overcurrents and to improve the homogeneity or uniformity of electron emission of the source and consequently the homogeneity of the brightness of the screens of the display means incorporating such a source, so that the manufacturing efficiency of said means is improved, by significantly reducing the excessively bright spots due to electron emitters, which produce an abnormally high electronic current.

Certainly U.S. Pat. No. 3789471 discloses a micropoint electron source in which each micropoint has a pedestal made from an electrically resistant material. However, the source according to the present invention, in which each conductive layer is entirely covered by a continuous resistive layer, has a major advantage compared with the known source, in that it permits a better dissipation of the thermal power given off in the "active" parts of the resistive material (resistive parts between the micropoints and the conductive layers), which gives the inventive source greater robustness and reliability.

Thus, in the source of U.S. Pat. No. 3789471 for a given micropoint, dissipation solely takes place via the corresponding conductive layer, whereas in the present invention said dissipation takes place not only via said conductive layer, but also laterally in the resistive layer, which surrounds the active part of the resistive layer located beneath the micropoint.

In particular, in applications of the "flat screen" type, the nominal current per emitter is below 1 microampere and is generally between 0.1 and 1 microampere. For the resistive layer to have an effect on the emission homogeneity and on the short-circuits liable to occur more particularly between the micropoints and the grid of the source, it is necessary for the resistance Ri produced by said resistive layer beneath the micropoints (electron emitters) to have a value of e.g. $10^7$ to $10^8$ ohms (corresponding to a voltage drop of 10 V in the resistive layer for a current of approximately 1 to 0.1 microampere per emitter).

In the case of short-circuits, all the voltage between the conductive layer and the grid and which is generally approximately 100 V, is transferred to the terminals of the resistive material. The thermal power given off in the active part then becomes very high and can be $(100)^2/10^8$W, i.e. 0.1 mW in a volume of approximately 1 micrometer$^3$ (volume of the active part).

As a result of the better heat dissipation possibilities provided, the source according to the invention is consequently very advantageous compared with that of the aforementioned prior art.

The source according to the invention can comprise a plurality of continuous resistive layers, respectively disposed on the conductive layers of the source. This plurality of resistive layers can be obtained by etching, between the cathode conductors, of a single, continuous resistive layer. However, preferably, the source according to the invention comprises a single, continuous resistive layer covering all the conductive layers of the source.

Each conductive layer can be made from a material chosen from the group including aluminium, antinomy-doped or fluorine-doped tin oxide tin-doped indium oxide and niobium.

In a particular realization, the resistive layer or layers are formed from a material chosen from the group including $In_20_3$, $SnO_2$, $Fe_2O_3$, ZnO and Si in doped form and having a resistivity higher than that of the material forming the conductive layer. Preferably, the resistivity of the resistive layer is between approximately $10^2$ and $10^6$ ohms.cm.

The choice of resistive materials with a resistivity between $10^2$ and $10^6$ ohms.cm and particularly between $10^4$ and $10^5$ ohms.cm makes it possible to obtain a high series resistance of e.g. $10^8$ ohms beneath each micropoint for a 1 to 0.1 micrometer thick resistive layer so as to obtain a good emission uniformity, a good limitation of overcurrents and a good heat dissipation in the case of shortcircuits. The resistive material can be advantageously constituted by silicon which, as a result of an appropriate doping, can have a high resistivity of e.g. approximately $10^4$ to $10^5$ ohms.cm .

The invention also relates to a cathodoluminescence display means comprising an electron source with micropoint emissive cathodes and a cathodoluminescent anode, characterized in that the source is in accordance with that according to the invention.

The present invention will be better understood from reading the following description of non-limitative embodiments, with reference to the attached drawings, wherein show:

FIG. 1 a diagrammatic view of an already described, known micropoint emissive cathode electron source.

FIG. 2 a diagrammatic view of an already described elementary electron emitter of said source.

Figure 3:
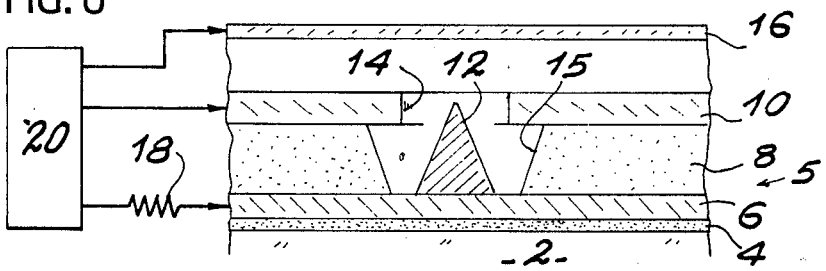

FIG. 3 a diagrammatic view of an electron source with electrical resistors.

Figure 4:
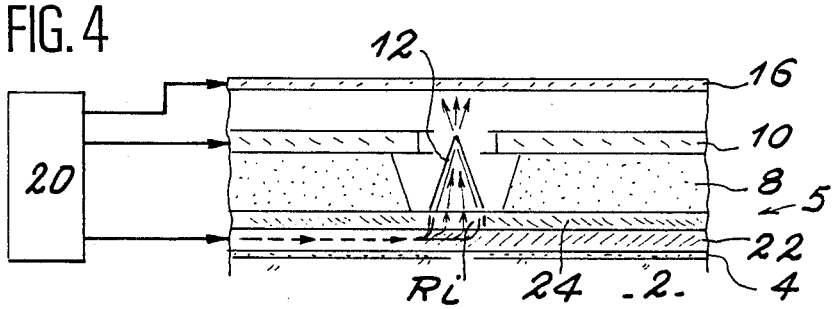

FIG. 4 a diagrammatic view of an embodiment of the source according to the invention using a plurality of continuous resistive layers.

Figure 5:
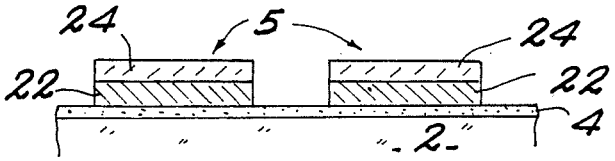

FIG. 5 diagrammatically a stage in the process of producing the source of FIG. 4.

Figure 6:
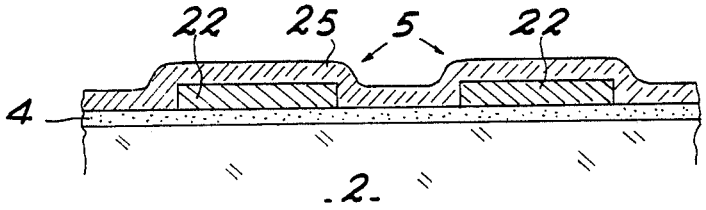

FIG. 6 diagrammatically a stage of the production process of another special embodiment of the source according to the invention.

The present invention will be described relative to FIGS. 4 to 6 in its particular application to displays.

FIG. 3 diagrammatically shows an electron source, the only difference between it and the known source, shown in FIGS. 1 and 2, is that to said known source has been added electrical resistors 18 of value Ro.

More specifically, an electrical resistor 18 of appropriate value Ro, given hereinafter, is connected in series with each cathode conductor 6. The known control means 20 make it possible to selectively raise the grids to positive potentials of e.g. approximately 100 V, with respect to the cathode conductors are electrically connected to the grids and the cathode conductors and the electrical connection between said means 20 and each cathode conductor is provided by means of an electrical resistor 18. The latter is consequently connected to the end of the connection 19 of the corresponding cathode conductor (end shown in FIG. 1).

The value Ro of each of the electrical resistors is calculated in such a way that the maximum intensity of the current liable to flow in the corresponding cathode conductor is below the critical intensity Io beyond which breakdowns occur. This value Io is dependent on the size and nature of the cathode conductors and always significantly exceeds the intensity of the current corresponding to the nominal operation of the cathode conductors.

Hereinafter is given in a purely indicative and non-limitative manner, an example of the calculation of the value Ro of the electrical resistors. The cathode conductors are made from indium oxide and have a width of 0.7 mm, a thickness of 0.2 micrometers, a length of 40 mm and a square resistance of 10 ohms. Therefore the electrical resistance of each cathode conductor has a value Rc of approximately 0.6 kiloohms. The critical value Io is approximately 10 milliamperes, the intensity of the nominal current being equal to or below approximately 1 milliampere. In order to excite a given intersection zone, the corresponding grid is raised to a positive potential U of approximately 100 V compared with the corresponding cathode conductor, the quantity Ro+Rc exceeding U/Io. Therefore the value Ro can be equal to approximately 10 kiloohms.

The source shown in FIG. 3 and which uses electrical resistors, for response time reasons, is only applicable to screens having a limited size, complexity and operational possibilities.

Thus, for a given intersection zone, the response time of the corresponding cathode conductor (column) is equal to the charging time of the capacitor formed by said cathode conductor, the corresponding grid (row) and the insulating layer separating the cathode conductor from the grid. This charging time is approximately the product of the charging resistance Ro+Rc by the capacitance of the capacitor in question.

For a 1 micrometer thick silica film 8, the capacitance is approximately 4 nanofarads/$cm^2$ and for a screen with a surface of 1 $dm^2$ and 256 columns and 256 rows, the surface of a column is approximately 0.25 $cm^2$. By taking for Ro+Rc a value of approximately $10^4$ ohms, a response time t of approximately 10 microseconds is obtained. At a frequency of 50 pictures or frames per second, the exciting time of a row for such a screen is $1/(50\times256)$ seconds, i.e. approximately 80 microseconds.

In this example, the response time consequently represents approximately 10% of the exciting time of a row, which is the maximum admissible limit if it is wished to avoid coupling phenomena. The latter is due to the fact that on a column, the brightness of one spot is influenced by the state of the preceding spot:

when the preceding spot is illuminated, the exciting time of the spot is equal to the exciting time of the row, because the column is already at emission potential, when the preceding spot is extinguished the exciting time of the spot is equal to the exciting time of the row, less the charging time, because the column must be raised to the emission potential.

If the charging time is not negligible compared with the exciting time of the row (e.g. if it exceeds 10% of the latter), the coupling effect is visible.

Thus, the solution using electrical resistors is not very satisfactory if it is wished either to obtain a good definition television picture (having at least 500 rows and grey levels) or form screens with a large surface area (more than 1 $dm^2$), the capacitance of the capacitor then being even greater than hereinbefore.

The problem of the response time can be solved by replacing said electrical resistors of value Ro by resistive layers. Thus, the current in the cathode conductors is limited, whilst still having a substantially zero access resistance thereto.

FIG. 4 diagrammatically shows an embodiment of the source according to the invention making it possible to solve said problem of the response time and the problems of heterogeneity and overcurrent referred to hereinbefore. The source diagrammatically shown in FIG. 4 differs from that described relative to FIGS. 1 and 2 by the fact that in the known source each cathode conductor 5 has a electrically conductive film 6, whereas in the source according to the invention shown in FIG. 4, each cathode conductor 5 has a first electrically conductive layer 22 resting on the electrically insulating layer 4 (as in the case of film 6 in FIGS. 1 to 3) and a second resistive layer 24 surmounting the conductive layer 22 and on which rest the pedestals of the micropoints 12 of the cathode conductor 5. In the embodiment shown in FIG. 4, each cathode conductor of the source is consequently in the form of a double layer strip, the control means 20 being connected to the conductive layers 22.

Conductive layer 22 is e.g. of aluminium. Resistive layer 24 serves as a buffer resistor between the conductive layer and the corresponding elementary emitters 12.

The resistive layer, which must obviously have a higher electrical resistance than that of the conductive layer, is preferably made from materials having a resistivity of approximately $10^2$ to $10^6$ ohms.cm compatible with the process for the production of the cathode conductors, (cf. particularly the description of FIG. 5).

In order to produce said resistive layer 24, it is e.g. possible to use indium (III) oxide $In_2O_3$, stannic oxide $SnO_2$, ferric oxide $Fe_2O_3$, zinc oxide ZnO or silicon in doped form, whilst ensuring that the chosen material has a r resistivity than that of the material chosen for producing the conductive layer.

The interest of the construction shown in FIG. 4 is inter alia based on the fact that it makes it possible to "transfer" the "protective" resistors, like resistors 18 in FIG. 3, between the conductive layer and each elementary emitter. This leads to a better response time without any significant increase in the cost of the electron source.

By appropriately choosing the resistivity of the resistive layer and its thickness, it is possible to limit the current intensity passing through each cathode conductor to a value equal to or below Io, whilst allowing the nominal current to flow into said cathode conductor. Thus, the resistive layer 24 also provides a protection against breakdown.

For a given cathode conductor, the charge resistance is that of the conductive layer and consequently corresponds to a response time well below 1 microsecond in the case of an aluminium conductive layer, which makes it possible to produce large complex screens.

As has already been indicated, the use of the resistive layer makes it possible to associate with each elementary emitter a resistor designated Ri, which enables said resistive layer to also have a homogenization function on the electronic emission. Thus, if an elementary electron emitter receives an excessive electrical current, the resulting voltage drop of Ri makes it possible to lower the voltage which is applied to said emitter and consequently decreases said current. Thus, Ri has a self-regulating effect on the current. Therefore any abnormal brightness of the spots is significantly reduced.

On the basis of FIG. 5, an explanation will now be given as to how it is possible to realize the source described relative to FIG. 4 and more specifically how it is possible to modify the process for the production of a micropoint emissive cathode electron source according to French Patent application No. 8601024 of Jan. 24 1986, referred to hereinbefore, in order to bring about the superimposing of the conductive layer and the resistive layer in each cathode conductor of the source.

Thus, for example, on a glass substrate 2 covered with a, for example, 100 nanometer thick silica film 4 is deposited by cathodic sputtering a first 200 nanometer thick aluminium layer 22 of resistivity $3.10^{-6}$ ohms.cm and then, on said aluminium layer, a second 150 nanometer thick second ferric oxide layer 24 of resistivity $10^4$ ohm.cm and once again using cathodic sputtering.

The two layers deposited in this way are then successively etched, e.g. through the same resin mask, by chemical etching in order to obtain a network of parallel cathode conductors or strips 5, whose length is 150 millimetres and whose width is 300 micrometers, the gap between the two strips 5 being 50 micrometers.

In a purely indicative and non-limitative manner, the etching of the aluminium layer can be carried out by means of a bath containing 4 volumes of 85% by weight $H_3PO_4$, 4 volumes of pure $CH_3COOH$, 1 volume of 67% by weight $HNO_3$ and 1 volume of $H_2O$ for 6 minutes at ambient temperature, in the case of a 200 nm thick aluminium layer and the etching of the ferric oxide layer can be carried out by means of the product Mixelec Melange PFE 8.1 marketed by Soprelec S. A., for 18 minutes at ambient temperature in the case of a 150 nm thick $Fe_2O_3$ layer.

The remainder of the structure (insulating layers, grids, emitters, etc.) is then realized in accordance with the process described in the aforementioned Patent application (cf. description of FIG. 5*ff* thereof).

The charge resistance is that of the aluminium layer and is approximately 75 ohms. The surface of a column is 0.45 $cm^2$. Therefore the response time is approximately 0.15 microsecond with a capacitance remaining approximately 4 nanofarads/$cm^2$.

In order to calculate the value of each resistor Ri, it is observed that the electrical current lines passing through the cathode conductors are located in the conductive layer and pass in the different corresponding micropoints, whilst traversing the resistive layer perpendicular thereto. Therefore, the resistance Ri is equal to the resistivity of the ferric oxide multiplied by the thickness of the resistive layer and divided by the base surface of an elementary electron emitter, which gives a resistance Ri equal in this case to approximately $10^7$ ohms.

Thus, under nominal operating conditions, a micropoint is traversed by a current of approximately 0.1 microampere, which corresponds to a voltage drop in Ri of 1 V, nominal operation not being disturbed.

With an exciting voltage of 100 V, the maximum current per emitter can be 10 microamperes. For a total emissive surface of an intersection zone of 0.1 $mm^2$ and having 1000 emitters, whilst assuming that all the emitters simultaneously supply the maximum current, i.e. said emitters are all short-circuited, which is very unlikely, the current flowing through the conductive layer would be 10 milliamperes, which is the maximum admissible value for preventing breakdown.

Finally, on assuming that for a voltage of 100 V, an elementary emitter has a current ten times higher than normal (1 microampere instead of 0.1 microampere), the voltage drop in Ri would be 10 V, which would reduce the emission of the elementary emitter by a coefficient of approximately 4 to 5 and would bring it to a value of approximately 0.2 to 0.3 microampere.

Thus, the homogenizing effect of resistor Ri is readily apparent, the excessively bright spots being eliminated.

Another embodiment of the source according to the invention will now be described relative to FIG. 6. In this case, the resistive material is advantageously an appropriately doped silicon. Use is made of a layer of said material which, preferably, is not etched between the cathode conductors, the leakage currents which it induces between said cathode conductors being acceptable.

Thus, for example, on a glass substrate 2, generally covered with an e.g. 100 nm thick silica film 4, by cathodic sputtering is deposited a first 200 nm thick aluminium layer 22 of resistivity $3.10^{-6}$ ohm.cm, which is then etched e.g. through a resin mask by chemical etching, so as to obtain a network of parallel conductive layers or strips with a length of 150 millimetres and a width of 300 micrometers in exemplified manner, the gap between two strips being 50 micrometers. The aluminium layer can e.g. be etched by means of the bath described in the previous example relative to FIG. 5. An e.g. phosphorus-doped silicon layer 25 of thickness 500 nm and resistivity $5.10^4$ ohms.cm is then deposited on the network of conductive layers by vacuum deposition methods.

The remainder of the structure (insulating layers, grids, emitters, etc.) is then produced in accordance with the process described in the aforementioned patent application.

The resistance or resistor Ri is in this case $2.5 \cdot 10^8$ ohms, being higher than in the previous example described relative to FIG. 5, which has the effect of reducing the leakage current due to possible short-circuits and has a greater effect on the homogenizationof the emission.

Obviously, in the embodiment of FIGS. 4 and 5, it is possible to use materials such that the resistance is also approximately $10^8$ ohms, particularly through the use of doped Si.

We claim:

1. Electron source comprising first parallel electrodes (5) serving as cathode conductors, each cathode conductor having an electrically conductive layer (22), whereof one face carries a plurality of micropoints (12) made from an electron emitting material and second parallel electrodes (10) serving as grids and which are electrically insulated from the cathode conductors (5) and form an angle therewith, which defines intersection zones of the cathode conductors and grids, the micropoints (12) being located at least in said intersection zones, the grids (10) also being positioned facing said faces and have holes (14) respectively facing the micropoints, the apex of each micropoint being substantially level with the hole corresponding thereto, the micropoints of each intersection zone being able to emit electrons when the corresponding grid is positively polarized with respect to the corresponding cathode conductor, an electrical current then flowing in each micropoint of the zone, characterized in that each cathode conductor (5) also has means for limiting the intensity of the electrical current flowing in each micropoint of said cathode conductor, said means having a continuous resistive layer (24,25) located on the conductive layer (22) of the corresponding cathode conductor (5), between said conductive layer and the corresponding micropoints (12), said corresponding micropoints resting on the resistive layer (24,25).

2. Source according to claim 1, characterized in that it comprises a plurality of continuous resistive layers (24) respectively arranged on the conductive layers of the source.

3. Source according to claim 2, characterized in that said plurality of resistive layers is obtained by etching, between the cathode conductors, of a single, continuous resistive layer.

4. Source according to claim 1, characterized in that it comprises a single, continuous resistive layer (25), which covers all the conductive layers of the source.

5. Source according to claim 1, characterized in that each conductive layer (22) is made from a material chosen in the group containing aluminium, stannic oxide doped with antinomy or fluorine and indium (III) oxide doped with tin and niobium.

6. Source according to claim 1, characterized in that each resistive layer (24,25) is made from a material chosen in the group including $In_2O_3$, $SnO_2$, $Fe_2O_3$, ZnO and doped Si and which has a resistivity higher than that of the material forming the conductive layer (22).

7. Source according to claim 1, characterized in that the resistivity of each resistive layer (24,25) is between approximately $10^2$ and $10^6$ ohms.cm .

8. Cathodoluminescence display means comprising a micropoint emissive cathode electron source and a cathodoluminescent anode (16), said electron source comprising first parallel electrodes (5) serving as cathode conductors, each cathode conductor having an electrically conductive layer (22), whereof one face carries a plurality of micropoints (12) made from an electron emitting material and second parallel electrodes (10) serving as grids and which are electrically insulated from the cathode conductors (5) and form an angle therewith, which defines intersection zones of the cathode conductors and grids, the micropoints (12) being located at least in said intersection zones, the grids (10) also being positioned facing said faces and have holes (14) respectively facing the micropoints, the apex of each micropoint being substantially level with the hole corresponding thereto, the micropoints of each intersection zone being able to emit electrons when the corresponding grid is positively polarized with respect to the corresponding cathode conductor, an electrical current then flowing in each micropoint of the zone, characterized in that each cathode conductor (5) also has means for limiting the intensity of the electrical current flowing in each micropoint of said cathode conductor, said means having a continuous resistive layer (24,25) located on the conductive layer (22) of the corresponding cathode conductor (5), between said conductive layer and the corresponding micropoints (12), said corresponding micropoints resting on the resistive layer (24,25).

* * * * *

US004940916B1

REEXAMINATION CERTIFICATE (3060th)

United States Patent [19]

Borel et al.

[11] B1 4,940,916

[45] Certificate Issued Nov. 26, 1996

[54] ELECTRON SOURCE WITH MICROPOINT EMISSIVE CATHODES AND DISPLAY MEANS BY CATHODOLUMINESCENCE EXCITED BY FIELD EMISSION USING SAID SOURCE

[75] Inventors: Michel Borel, Le Touvet; Jean-Francois Boronat, Grenoble; Robert Meyer, St Nazaire les Eymes;; Philippe Rambaud, Claix, all of France

[73] Assignee: Commissariat a l'Energie Atomique, Paris, France

Reexamination Request:
No. 90/003,764, Mar. 22, 1995

Reexamination Certificate for:

| | |
|---|---|
| Patent No.: | **4,940,916** |
| Issued: | **Jul. 10, 1990** |
| Appl. No.: | **266,681** |
| Filed: | **Nov. 3, 1988** |

[30] Foreign Application Priority Data

Nov. 6, 1987 [FR] France ..... 87 15432

[51] Int. Cl.[6] ..... H01J 1/30; H01J 1/90; H01J 29/04

[52] U.S. Cl. ..... 315/306; 313/309; 313/336; 313/351; 313/444

[58] Field of Search ..... 313/309, 336, 313/351

[56] References Cited

FOREIGN PATENT DOCUMENTS 0234989 9/1987 European Pat. Off. .

OTHER PUBLICATIONS

Kon Jiun Lee, "Current Limiting of Field Emitter Array Cathodes," doctoral thesis, Georgia Institute of Technology, 1986, UMI Document 8628359.

*Primary Examiner*—Nimeshkumar D. Patel

[57] ABSTRACT

Electron source with micropoint emissive cathodes and display means by cathodoluminescence excited by field emission and using said source. Each cathode (5) comprises an electrically conductive layer (22) and micropoints (12) and, according to the invention, a continuous resistive layer (24) is provided between the conductive layer and the micropoints. The display means comprises a cathodoluminescent anode (16) facing the source.

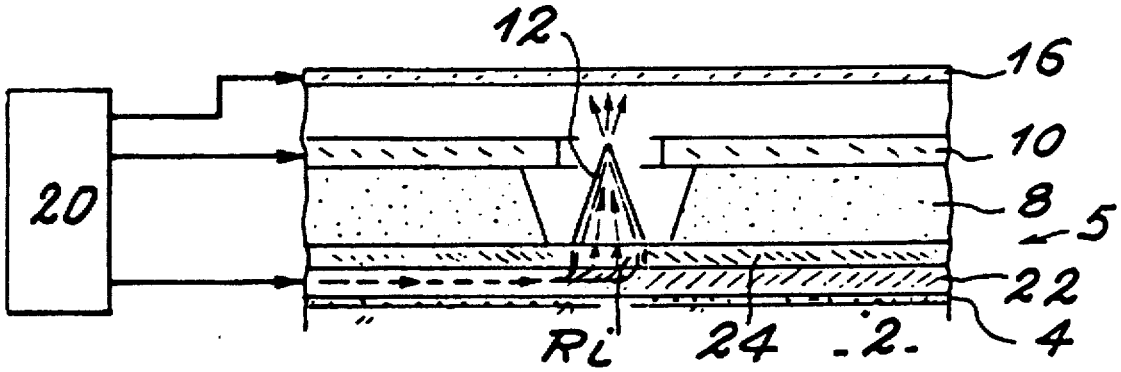

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 1, lines 16–21:

French Patent application No. 8601024 of Jan. 24 1986 *by the same inventors* (French Patent No. 2593953, *the French counter part to European Publication 0234989 and also the foreign priority document to U.S. Application Serial No. 1,159, filed Jan. 7, 1987, now U.S. Patent No. 4,857,161), and incorporated herein by reference,* discloses a display by cathodoluminescence excited by field emission, comprising an electron source with micropoint emissive cathodes. It also describes a process for the production of said display.

AS A RESULT OF REEXAMINATION, IT HAS BEEN DETERMINED THAT:

Claims 1 and 8 are determined to be patentable as amended.

Claims 2–6 and 7, dependent on an amended claim, are determined to be patentable.

New claims 9–23 and 24 are added and determined to be patentable.

1. Electron source comprising first parallel electrodes (5) serving as cathode conductors, each cathode conductor having an electrically conductive layer (22), whereof one face carries a plurality of micropoints (12) made from an electron emitting material and second parallel electrodes (10) serving as grids and which are electrically insulated from the cathode conductors (5) and form an angle therewith, which defines intersection zones of the cathode conductors and grids, the micropoints (12) being located [at least] *on said cathode conductor* in said intersection zones, the grids (10) also being positioned facing said faces and have holes (14) respectively facing the micropoints, the apex of each micropoint being substantially level with the hole corresponding thereto, the micropoints of each intersection zone being able to emit electrons when the corresponding grid is positively polarized with respect to the corresponding cathode conductor, an electrical current then flowing in each micropoint of the zone, characterized in that each cathode conductor (5) also has means for limiting the intensity of the electrical current flowing in each micropoint of said cathode conductor, said means [having] *comprising* a continuous resistive layer (24, 25) located on the conductive layer (22) of the corresponding cathode conductor (5), *such that the cathode conductor is completely and continuously coated with the resistive layer,* between said conductive layer and the corresponding micropoints (12), said corresponding micropoints resting on the resistive layer (24, 25), *and wherein said continuous resistive layer provides for dissipation of thermal energy generated at said intersection zones.*

8. Cathodoluminescence display means comprising a micropoint emissive cathode electron source and a cathodoluminescent anode (16), said electron source comprising first parallel electrodes (5) serving as cathode conductors, each cathode conductor having an electrically conductive layer (22), whereof one face carries a plurality of micropoints (12) made from an electron emitting material and second parallel electrodes (10) serving as grids and which are electrically insulated from the cathode conductors (5) and form an angle therewith, which defines intersection zones of the cathode conductors and grids, the micropoints (12) being located [at least] *on said cathode conductor* in said intersection zones, the grids (10) also being positioned facing said faces and have holes (14) respectively facing the micropoints, the apex of each micropoint being substantially level with the hole corresponding thereto, the micropoints of each intersection zone being able to emit electrons when the corresponding grid is positively polarized with respect to the corresponding cathode conductor, an electrical current then flowing in each micropoint of the zone, characterized in that each cathode conductor (5) also has means for limiting the intensity of the electrical current flowing in each micropoint of said cathode conductor, said means [having] *comprising* a continuous resistive layer (24, 25) located on the conductive layer (22) of the corresponding cathode conductor (5), *such that the cathode conductor is completely and continuously coated with the resistive layer,* between said conductive layer and the corresponding micropoints (12), said corresponding micropoints resting on the resistive layer (24, 25), *and wherein said continuous resistive layer provides for dissipation of thermal energy generated at said intersection zones.*

*9. A cathodoluminescent display comprising:*

*a substrate made from a first insulating material;*

*first parallel electrodes (5) serving as cathode conductors, said first parallel conductors comprising a first continuous layer made of a first conductive material on said substrate, and a second continuous layer made of a resistive material on said first conductive layer,*

*said first layer and said second layer being etched so as to form a first network of parallel strips, each parallel strip comprising a conductive strip completely covered by a continuous strip of said resistive material;*

*second parallel electrodes (10) serving as grids, said second parallel electrodes comprising a third layer made of a second insulating material over said first network of parallel strips, and a fourth layer made of a second conductive material on said third layer, said fourth layer being etched so as to form a second network of parallel strips, said second network of parallel strips being positioned facing said first network of parallel strips and forming an angle with said first network of parallel strips which defines intersection zones between said first and second networks;*

*holes in said fourth and third layers at said intersection zones;*

*micropoints located in said intersection zones made of an electron emitting material in said holes, said micropoints resting on said continuous strips of said resistive material, the apex of each micropoint being substantially level with the hole corresponding thereto, wherein the micropoints at said intersection zones are*

*able to emit electrons when the corresponding grid is positively polarized with respect to the corresponding cathode conductor, an electrical current then flowing in each micropoint of the zone;*

*wherein said continuous resistive layer limits the intensity of the electrical current flowing in each micropoint of said cathode conductor and provides for dissipation of thermal energy generated at said intersection zones; and*

*a screen with at least a cathodoluminescent layer facing said second network of parallel strips.*

*10. The cathodoluminescent display according to claim 9, wherein said second layer made of said resistive material has a thickness larger than approximately 150 nanometers.*

*11. The cathodoluminescent display according to claim 10, wherein said second layer made of said resistive material has a thickness between approximately 150 nanometers and approximately 500 nanometers.*

*12. The cathodoluminescent display according to claim 9, wherein said resistive material has a resistivity larger than approximately $10^2$ ohms.cm.*

*13. The cathodoluminescent display according to claim 12, wherein said resistive material has a resistivity between approximately $10^2$ ohms.cm and $10^6$ ohms.cm.*

*14. The cathodoluminescent display according to claim 9, wherein said resistive material has a resistivity larger than approximately $10^4$ ohms.cm.*

*15. The cathodoluminescent display according to claim 14, wherein said resistive material has a resistivity between approximately $10^4$ ohms.cm and $5.10^4$ ohms.cm.*

*16. The cathodoluminescent display according to claim 9, wherein said resistive material is made from a material chosen from the group including $In_2O_3$, $SnO_2$, $Fe_2O_3$, ZnO and doped Si and which has a resistivity higher than that of said first conductive material.*

*17. A cathodoluminescent display comprising:*

*a substrate made from a first insulating material,*

*first parallel electrodes (5) serving as cathode conductors, said parallel electrodes comprising a first continuous layer made of a first conductive material on said substrate, said first layer being etched so as to form a first network of parallel strips, and a second continuous layer made of a resistive material completely covering said first network and on said substrate;*

*second parallel electrodes (10) serving as grids, said second parallel electrodes comprising a third layer made of a second insulating material over said second layer, and a fourth layer made of a second conductive material on said third layer, said fourth layer being etched so as to form a second network of parallel strips, said second network of parallel strips being positioned facing said first network of parallel strips and forming an angle with said first network of parallel strips which defines intersection zones between said first and second networks;*

*holes in said fourth and third layers at said intersection zones;*

*micropoints located in said intersection zones made of an electron emitting material in said holes, said micropoints resting on said continuous second layer made of said resistive material, the apex of each micropoint being substantially level with the hole corresponding thereto, wherein the micropoints at said intersection zones are able to emit electrons when the corresponding grid is positively polarized with respect to the corresponding cathode conductor, an electrical current then flowing in each micropoint of the zone;*

*wherein said continuous resistive layer limits the intensity of the electrical current flowing in each micropoint of said cathode conductor and provides for dissipation of thermal energy generated at said intersection zones; and,*

*a screen with at least a cathodoluminescent layer facing said second network of parallel strips.*

*18. The cathodoluminescent display according to claim 17, wherein said second layer made of said resistive material has a thickness larger than approximately 150 nanometers.*

*19. The cathodoluminescent display according to claim 18, wherein said second layer made of said resistive material has a thickness between approximately 150 nanometers and approximately 500 nanometers.*

*20. The cathodoluminescent display according to claim 17, wherein said resistive material has a resistivity larger than approximately $10^2$ ohms.cm.*

*21. The cathodoluminescent display according to claim 20, wherein said resistive material has a resistivity between approximately $10^2$ ohms.cm and $10^6$ ohms.cm.*

*22. The cathodoluminescent display according to claim 17, wherein said resistive material has a resistivity larger than approximately $10^4$ Ohms.cm.*

*23. The cathodoluminescent display according to claim 22, wherein said resistive material has a resistivity between approximately $10^4$ ohms.cm and $5.10^4$ ohm.cm.*

*24. The cathodoluminescent display according to claim 17, wherein said resistive material is made from a material chosen from the group including $In_2O_3$, $SnO_2$, $Fe_2O_3$, ZnO and doped Si and which as a resistivity higher than that of said first conductive material.*

* * * * *